United States Patent [19]

Andersson

[11] Patent Number: 4,861,430

[45] Date of Patent: Aug. 29, 1989

[54] CONTROLLING A PAPER WEB PATH IN THE PRESS SECTION WITH AN IMPERMEABLE BELT

[75] Inventor: Nils T. Andersson, Halmstad, Sweden

[73] Assignee: Nordiskafilt AB, Halmstad, Sweden

[21] Appl. No.: 194,231

[22] PCT Filed: Dec. 8, 1986

[86] PCT No.: PCT/SE86/00555

§ 371 Date: May 16, 1988

§ 102(e) Date: May 16, 1988

[87] PCT Pub. No.: WO87/03631

PCT Pub. Date: Jun. 18, 1987

[30] Foreign Application Priority Data

Dec. 9, 1985 [SE] Sweden ..... 8505796

[51] Int. Cl.[4] ..... D21F 3/02

[52] U.S. Cl. ..... 162/205; 162/305; 162/358; 162/360.1

[58] Field of Search ..... 162/202, 204, 205, 305, 162/358, 360.1; 100/154, 155

[56] References Cited

U.S. PATENT DOCUMENTS

| | | | |
|---|---|---|---|
| 3,257,268 | 6/1966 | Wrist et al. | 162/358 |
| 3,325,351 | 6/1967 | Orton, Jr. | 162/358 |
| 3,748,225 | 7/1973 | Busket et al. | 162/358 |
| 4,173,249 | 11/1979 | Holkko et al. | 162/360.1 |
| 4,272,317 | 6/1981 | Roerig | 162/358 |
| 4,555,306 | 11/1985 | Lundstrom | 162/358 |
| 4,675,079 | 6/1987 | Webster | 162/360.1 |

*Primary Examiner*—Karen Hastings

*Attorney, Agent, or Firm*—Kane, Dalsimer, Sullivan, Kurucz, Levy, Eisele & Richard

[57] ABSTRACT

A method and a device for controlling a paper web which is leaving a press nip in the press section of a paper-making machine. The paper web is intended to follow a felt after the press nip. Control of the paper web is achieved in accordance with the teachings of the invention by preventing air admission to the side of the felt facing away from the paper web during the expansion phase of said felt after the press nip, whereby a pressure is generated, sucking the paper web against the felt. Air admission to the felt is prevented by means of an impermeable belt which is arranged to travel in a separate loop at the same speed as the felt. The belt extends closely adjacent the felt against the side thereof facing away from the web through one or several press nips and over a distance following said press nip/nips.

6 Claims, 1 Drawing Sheet

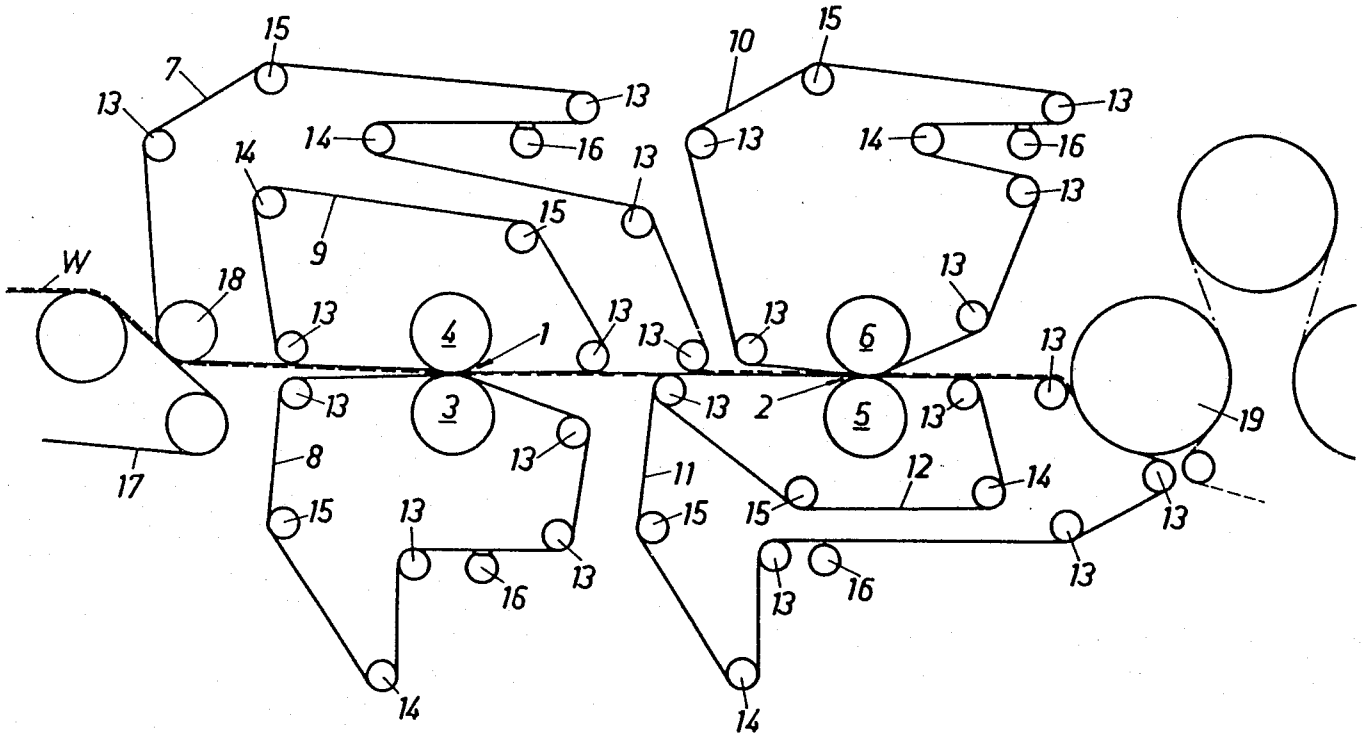
1
2
3
4
5
6
7
8
9
10
11
12
13
14
15
16
17
18
19
W

CONTROLLING A PAPER WEB PATH IN THE PRESS SECTION WITH AN IMPERMEABLE BELT

BACKGROUND OF THE INVENTION

The invention relates to a method of controlling the paper web when leaving the press nip, and to a device for performing the method.

A paper web is dewatered when passing through a press nip together with one or several felts and/or belts. In one type of press nip the paper web is running through the press nip between two press felts, known as a double-felted press nip. After the press nip the paper web should follow one of the felts. It is sometimes a problem to control the paper web path, and the paper web may sometimes also have a tendency to follow the other felt, especially after a stop or break of the paper web. The higher speeds of modern papermaking machines have made the problem more pronounced. Another reason for the problem is that all the felts are not replaced at the same time but individually, depending on felt wear. The paper web tends to follow the felt having the smoothest surface in general the felt which has been in operation for the longest period of time. The problem is more obvious in the case of tail-threading through the press nip or after web breaks. In such cases the web may follow an undesirable path through the press section, causing time-consuming operational standstills.

Different ways to achieve control of the web have been tried. One way is to adjust the press roll interrelationship, i.e. the geometry of the rolls, in such a manner that the felt which the web has to follow expands, while its reverse side still abuts against the press roll whereas the second felt expands by means of air supplied to its reverse side. The vacuum thus generated in the felt to which air is not supplied, exerts a certain pressure against the web for guiding the web in the desired web path. However, this method suffers from considerable drawbacks since the geometry of the press and the felt angles are fixed within narrow limits. The force acting on the web is not sufficient to press the paper web against the desired one of the felts in a satisfactory manner.

Another prior-art way of solving the problem is to manufacture one of the felts impermeable, at least over a certain part of its thickness, to such an extent that it becomes practically impossible for air to penetrate through the felt. A felt of this kind will then serve as a web transport felt on which the web is carried through the papermaking machine, and particularly through the machine press section. After a certain period of operation, the felt surface becomes very smooth and this creates difficulties when the web is about to leave the transport felt at the entrance to the dryer section. At this point the web adheres so firmly to the felt that it cannot be removed therefrom.

SUMMARY OF THE INVENTION

It is an object of the invention to eliminate these drawbacks and to this end the invention has for its purpose to indicate a method of controlling the paper web leaving the press nip in the press section of a papermaking machine, which paper web, after the press nip, is intended to follow a permeable felt. The method is characterized therein that at least during the expansion of the felt after the press nip air admission is prevented to the side of that felt which faces away from the paper web.

The invention also concerns a device for performing the method in accordance with claim 1 in press nips of papermaking machines for the purpose of controlling the paper web leaving the press nip. The device is characterized by an impermeable belt which is arranged to run in contact with the felt which the web is intended to follow after the press nip so as to abut against the side of the felt which faces away from the paper web, said abutment being effected through one or several press nips and over a certain distance thereafter, said belt also arranged to be advanced in a separate loop and at the same speed as the felt.

Further characteristics of the invention will appear from the dependent claims.

BRIEF DESCRIPTION OF THE DRAWING

The invention will be described in closer detail in the following with reference to the accompanying single figure of the drawing, labelled FIG. 1.

DETAILED DESCRIPTION OF A PREFERRED EMBODIMENT

The illustrated embodiment of a dewatering press section in accordance with the present invention consists of two press nips 1 and 2 each one formed by two solid press rolls 3, 4 and 5, 6, respectively. Through the first nip 1 a paper web W runs between two air permeable press felts, an upper pick-up felt 7 and a bottom felt 8. Arranged in a loop inside the pick-up felt 7 is an air impermeable belt 9. In the same way the paper web runs through the second nip 2 between two air permeable felts, a top felt 10 and a bottom felt 12. Arranged in a loop inside the bottom felt 11 is an air impermeable felt 12. The felts and belts are guided by lead rolls 13, stretch rolls 14 and guide rolls 15. Each one of the permeable felts also runs over suction boxes 16 for dewatering of the felts.

The web W is formed on a forming fabric 17 and is picked up by vacuum in a suction pick-up roll 18. The pick-up felt 7 wraps the pick-up roll and the paper web is transferred from the forming fabric to the face side of the pick-up felt 7 and is carried by the felt to the first press nip 1. When only the two felts 7 and 8 together with the paper web run through the press nip, a problem could arise in guiding the web still in contact with the face of the pick-up felt 7 after leaving the press nip. Without suction boxes in the top roll 4 a smooth surface of felt 8 may transfer the web to the bottom press felt instead of letting it be carried on the bottom side of the pick-up felt 7. However, the impermeable belt 9 is running close together with the pick-up felt 7 through and after the press nip 1. Thus air supply to the pick-up felt 7 is prevented when the felt expands after the nip. A vacuum is created in the felt to press the web against the bottom face of the pick-up felt 7.

When running from the first to the second press nip the web is transferred from the pick-up felt 7 onto the bottom felt 11. This transfer is facilitated, because ahead of the transfer point the belt 9 no longer has contact with the pick-up felt 7 thus allowing air to penetrate the felt from the reverse side thereof and remove the vacuum. The web is carried by the bottom press felt 11 into the second press nip 2.

As can be seen from the Figure respective lead rolls 13 and felt 11 serve as first, second and third sequentially arranged means for first separating the felt 8 from the paper web, felt 7 and impermeable belt 9, then separating the impermeable belt 9 from felt 7, then separating the paper web from felt 7 to felt 11. The position of the lead roll 13 after the press nip 1 in belt loop 9 also serves as means to maintain contact between belt 9 and felt 7 after the press nip 1.

Also the second press nip is a double-felted press nip, where the web is pressed between the top felt 10 and the bottom felt 11. The impermeable belt 12 is running close together with the top part of the bottom felt 11. The combination felt 11/belt 12 prevents the air from penetrating the felt. It makes it even easier to transfer the web from the pick-up felt 7 to the bottom felt 11, but above all, it keeps the web onto the bottom felt 11 after the press nip. The web is carried by the bottom felt 11 to the first dryer cylinder 19. Before the transfer point the belt 12 loses contact with the felt 11 making the felt accessible to admission of air from the inside of the felt. The vacuum is released and the web can easily be separated from the felt 11 and be transferred onto the dryer cylinder 19. It has been suggested to make the felt 11 impermeable. Such an arrangement has the same effect after the press nip as the combination of the felt 11 and the belt 9, but it causes a problem when transferring the web from the felt 11 to the dryer cylinder 19. This is the case particularly after some time of operation when the surface of the felt 12 becomes smooth.

The felts and belts may be made endless, but it is likewise possible to use seamed felts and belts.

The method and the device in accordance with the invention provide several advantages, among them less risk for rewetting and in addition, the arrangement ensures that the web will always follow the desired one of the felts.

The impermeable belts 9 and 12 for instance could be a stable plastics belt or a woven belt which is impregnated in any convenient manner in order to become impermeable.

The embodiments of the invention described in the aforegoing are to be regarded as examples only, and a variety of other modifications and embodiments are possible within the scope of the appended claims. The belts 9 and 12 need not be in engagement with the felts 7 and 11, respectively, a distance ahead of the entrance into the press nips. Alternatively, the belts 9 and 12 may be wrapped around the press rolls 4 and 5, respectively. It is also possible to arrange pick-up from the forming fabric 17 to the pick-up felt 7 by wrapping the belt 9 around a solid pick-up roll 18. Further, the felts and/or belts may travel through several press nips. In its longest extension a felt may serve as a pick-up felt for removing the paper web from the forming fabric and then carry the web through all presses up to the dryer section. Such a felt can be sealed by positioning impermeable belts in the felt parts that are of critical importance to web guidance. The material making up the belts 9 and 12 can be chosen freely. The purpose of the belts 9 and 12 is to block admission of air to the permeable felts from the side of the felt opposite that of the paper web over part of the felt loops. Such periodical blockage may be achieved by other means, e.g. by using fixed elements or surfaces in the form of e.g. a table below the felt.

What I claim is:

1. A method for controlling a paper web leaving a press nip formed by a first press roller and a second press roller in a press section of a papermaking machine comprising:

passing said paper web through said press nip between a first permeable press felt and a second permeable press felt, said first permeable press fabric having a front side in contact with said paper web and a back side facing away from said paper web and toward said first press roller;

passing an impermeable element through said press nip between said back side of said first permeable press felt and said first press roller so that, when said first permeable press felt expands upon leaving said press nip, a partial vacuum is created within said first permeable press felt to hold said paper web in contact therewith;

separating said second permeable press felt from said paper web, said first permeable press felt, and said impermeable element upon leaving said press nip, while maintaining contact between said impermeable element and said back side of said first permeable press felt and between said front side of said first permeable press felt and said paper web;

next separating said impermeable element from said back side of said first permeable press felt, so that said partial vacuum within said first permeable press felt is removed; and next separating said paper web from said front side of said first permeable press fabric.

2. The method as claimed in claim 1 further comprising the step of:

bringing said back side of said first permeable press felt into contact with said impermeable element before said first permeable press fabric, said second permeable press felt, and said paper web enter said press nip, so that the admission of air to said back side of said first permeable press felt is prevented.

3. In a press section of a papermaking machine including first and second press rollers and first and second permeable press felts, an apparatus for controlling a paper web leaving a press nip formed by said first press roller and said second press roller between said first permeable press felt, having a front side in contact with said paper web and a back side, and said second permeable press felt comprising:

an impermeable belt running in a separate loop through said press nip between said first press roller and the back side of said first permeable press felt, said impermeable belt passing through said press nip in the same direction and at the same speed as said first permeable press felt;

first means for separating said second permeable press felt from said paper web, said first permeable press felt, and said impermeable belt after emerging from said press nip;

means for maintaining contact between said impermeable belt and said back side of said first permeable press felt after emerging from said press nip, the impermeable belt being structured and arranged to create a partial vacuum in said first permeable felt such that contact between said front side of said first permeable felt and said paper web is maintained for a distance after emerging from said press nip;

second means for thereafter separating said impermeable belt from said back side of said first permeable press felt so that said partial vacuum within said first permeable press felt is removed;

third means for thereafter separating said paper web from said front side of said first permeable press felt; said first, second, and third means for separating being arranged sequentially with respect to each other; and means for guiding said impermeable belt around said separate loop through said press nip between said first press roller and said back side of said first permeable press felt.

4. An apparatus as claimed in claim 3 wherein said means for maintaining contact between said impermeable belt and said back side of said first permeable press felt after emerging from said press nip is a first lead roll positioned after said press nip in the direction of travel of said paper web.

5. An apparatus as claimed in claim 3 further comprising:

means for bringing said back side of said first permeable press felt into contact with said impermeable belt before said first permeable press felt, said second permeable press felt and said paper web enter said press nip.

6. An apparatus as claimed in claim 5 wherein said means for bringing said back side of said first permeable press felt into contact with said impermeable belt is a second lead roll positioned before said press nip in the direction of travel of said paper web.

* * * * *